US006396010B1

(12) United States Patent
Woodward et al.

(10) Patent No.: US 6,396,010 B1
(45) Date of Patent: May 28, 2002

(54) SAFETY EDGE SWITCH FOR A MOVABLE DOOR

(75) Inventors: Jerry Woodward, Greensburg; Barry Kovac; Terry Kovac, both of Yukon, all of PA (US)

(73) Assignee: Matamatic, Inc., New Stanton, PA (US)

( * ) Notice: Subject to any disclaimer, the term of this patent is extended or adjusted under 35 U.S.C. 154(b) by 22 days.

(21) Appl. No.: 09/690,381

(22) Filed: Oct. 17, 2000

(51) Int. Cl.[7] ..... H01H 3/16

(52) U.S. Cl. ..... 200/61.43; 200/85 R; 200/86 R; 200/86 A; 49/26

(58) Field of Search ..... 200/61.41–61.44, 200/61.62, 61.71, 61.73, 61.74, 61.76, 61.81, 85 R, 86 R, 86 A, 511; 49/26–28

(56) References Cited

U.S. PATENT DOCUMENTS

| | | | |
|---|---|---|---|
| 2,951,817 | A | 9/1960 | Myers |
| 3,133,167 | A | 5/1964 | Miller |
| 3,260,812 | A | 7/1966 | Miller |
| 3,315,050 | A | 4/1967 | Miller |
| 3,321,592 | A | 5/1967 | Miller |
| 3,462,885 | A | 8/1969 | Miller |
| 3,634,334 | A | 1/1972 | Burgess |
| 3,668,337 | A | 6/1972 | Sinclair |
| 3,693,026 | A | 9/1972 | Miller |
| 3,855,733 | A | 12/1974 | Miller |
| 3,859,485 | A | 1/1975 | Blinkilde et al. |
| 3,920,940 | A | 11/1975 | Brown et al. |
| 4,014,217 | A | 3/1977 | Lagasse et al. |
| 4,051,336 | A | 9/1977 | Miller |
| 4,121,488 | A | 10/1978 | Akiyama |
| 4,137,116 | A | 1/1979 | Miller |
| 4,143,367 | A | 3/1979 | Schestag |
| 4,172,216 | A | 10/1979 | O'Shea |
| 4,200,777 | A | 4/1980 | Miller |
| 4,273,974 | A | 6/1981 | Miller |
| 4,349,710 | A | 9/1982 | Miller |
| 4,481,815 | A | 11/1984 | Overton |
| 4,497,989 | A | 2/1985 | Miller |
| 4,532,388 | A | 7/1985 | Sackmann et al. |
| 4,620,072 | A | 10/1986 | Miller |
| 4,640,137 | A | 2/1987 | Trull et al. |
| 4,661,664 | A | 4/1987 | Miller |
| 4,785,143 | A | 11/1988 | Miller |
| 4,837,548 | A | 6/1989 | Lodini |
| 4,845,323 | A | 7/1989 | Beggs |
| 4,876,419 | A | 10/1989 | Lodini |
| 4,876,420 | A | 10/1989 | Lodini |
| 4,900,497 | A | 2/1990 | Lodini |
| 4,908,483 | A | 3/1990 | Miller |

(List continued on next page.)

FOREIGN PATENT DOCUMENTS

| | | |
|---|---|---|
| DE | 1 942 565 | 4/1971 |
| DE | 2 026 894 | 12/1971 |
| EP | 0 167 341 A2 | 1/1986 |
| EP | 0 293 734 A1 | 12/1988 |
| GB | 2 045 527 A | 10/1980 |

*Primary Examiner*—Lincoln Donovan
*Assistant Examiner*—Kyung S. Lee
(74) *Attorney, Agent, or Firm*—Dilworth & Barrese, LLP

(57) ABSTRACT

A safety edge switch for a motorized door includes a longitudinally extending base, a resiliently deformable material, an electrode array of a plurality of spaced apart conductive segments, and an array of bridging members. The switch is normally in the closed configuration. Contact with an object in the path of the moving door causes one or more bridging members to break contact with the corresponding electrode segments, thereby forming an open circuit and sending a signal to the door control system to stop or reverse the movement of the door.

20 Claims, 6 Drawing Sheets

U.S. PATENT DOCUMENTS

| | | | | |
|---|---|---|---|---|
| 4,920,241 | A | | 4/1990 | Miller |
| 4,951,985 | A | | 8/1990 | Pong et al. |
| 4,954,673 | A | | 9/1990 | Miller |
| 4,964,302 | A | | 10/1990 | Grahn et al. |
| 4,972,054 | A | | 11/1990 | Miller et al. |
| 4,977,386 | A | | 12/1990 | Lodini |
| 5,010,774 | A | | 4/1991 | Kikuo et al. |
| 5,019,797 | A | | 5/1991 | Marstiller et al. |
| 5,019,950 | A | | 5/1991 | Johnson |
| 5,023,411 | A | | 6/1991 | Miller et al. |
| 5,027,552 | A | | 7/1991 | Miller et al. |
| 5,060,527 | A | | 10/1991 | Burgess |
| 5,066,835 | A | | 11/1991 | Miller et al. |
| 5,072,079 | A | | 12/1991 | Miller |
| 5,089,672 | A | | 2/1992 | Miller |
| 5,132,583 | A | | 7/1992 | Chang |
| 5,148,911 | A | | 9/1992 | Miller et al. |
| 5,264,824 | A | | 11/1993 | Hour |
| 5,438,798 | A | * | 8/1995 | Plamper et al. ..... 200/61.43 |
| 5,477,217 | A | | 12/1995 | Bergan |
| 5,481,076 | A | * | 1/1996 | Mullet et al. ..... 200/61.43 |
| 5,510,812 | A | | 4/1996 | O'Mara et al. |
| 5,695,859 | A | | 12/1997 | Burgess |
| 5,828,289 | A | | 10/1998 | Burgess |
| 5,856,644 | A | | 1/1999 | Burgess |
| 5,886,615 | A | | 3/1999 | Burgess |
| 5,910,355 | A | | 6/1999 | Burgess |
| 5,962,118 | A | | 10/1999 | Burgess |
| 6,072,130 | A | | 6/2000 | Burgess |
| 6,114,645 | A | | 9/2000 | Burgess |
| 6,121,869 | A | | 9/2000 | Burgess |

* cited by examiner

SAFETY EDGE SWITCH FOR A MOVABLE DOOR

BACKGROUND

1. Field of the Invention

The present invention relates to a switching mechanism, particularly a sensing edge for a powered movable door, and more particularly to a switching mechanism for stopping or reversing the movement of a closing door upon contact with an object in the path of the door.

2. Background of the Art

Sensing edge switches for movable doors are known. For example, U.S. Pat. No. 5,072,079 to Miller discloses a sensing edge for a door which includes a first sheet of electrically conductive material, a layer of non-conductive material, a second sheet of electrically conductive material, a second sheet of resiliently compressible material and an elongate inner core having a predetermined elastic compressibility.

U.S. Pat. No. 4,051,336 to Miller discloses a pressure sensitive door edge construction including a channel facing outwardly from a door and having in-turned lips defining a slot therebetween, a resiliently depressible bead extending exteriorly along the channel bridging the slot, a reduced neck on the inner side of the bead extending through the slot, an inner enlargement on the neck interiorly of the channel, and pressure responsive means operatively connected to the bead for stopping door movement upon bead depression.

Both these and other safety edges operate by a switch closing operation. That is, the safety edges include two or more electrode strips which are spaced apart from each other. When an object is encountered by the safety edge during the closing of the door, one electrode strip is moved into contact with the other to close the switch, i.e., to move the switch into the "on" configuration to complete the electric circuit and allow current to flow. This operation typically powers a signal for reversing or stopping the motion of the door.

Such "normally open" door edge safety switches suffer from certain disadvantages. For example, monitoring the working condition of such switches usually requires a special signal conditioner, or a four wire system. Moreover, the molded rubber cover used in door edge safety switches usually has disparities of shape over its length. Inconsistencies in thickness of the rubber, for example, can keep the electrode strips permanently in contact at some point along the length of the strips, especially in sensitive switches wherein the electrode strips are positioned close together. What is needed is a simplified safety edge switch for a door wherein the sensitivity is not limited by the disparities in the rubber cover. These and other advantages are realized in the safety edge switch described herein.

SUMMARY

A safety edge switch for a movable door is provided herein. The safety edge switch includes: a base; a first resiliently deformable material; an electrode array which includes a plurality of segments of a first conductive material, each segment being separated from neighboring segments by respective gaps, the electrode array being in a fixed position relative to the base; and, a second array which includes a plurality of spaced apart electrically conductive bridging members, the second array being movable in response to deformation of the first resiliently deformable material from a closed circuit first position wherein the bridging members are each in contact with respective segments of the first conductive material so as to bridge a respective gap between said respective segments, and a force deformation second position wherein at least one of the bridging members is not in contact with at least one respective segment of the electrode array, wherein in the closed circuit position the segments of the electrode array are electrically connected in series so as to form an unbroken electrical path, and in the second position the electrical path is broken by at least one unbridged gap so as to form an open circuit.

BRIEF DESCRIPTION OF THE DRAWINGS

Various embodiments are described below with reference to the drawings, wherein.

DETAILED DESCRIPTION OF PREFERRED EMBODIMENT(S)

The safety edge switch of the present invention is adapted to be mounted to the leading edge of a motorized movable door, particularly a sliding door such as for example, a garage door, train door, elevator door, factory door, and the like, and for revolving doors such as those used in building entrances. The safety edge switch of the present invention can also be adapted for use in mat switches, strip switches and the like.

Figure 1:
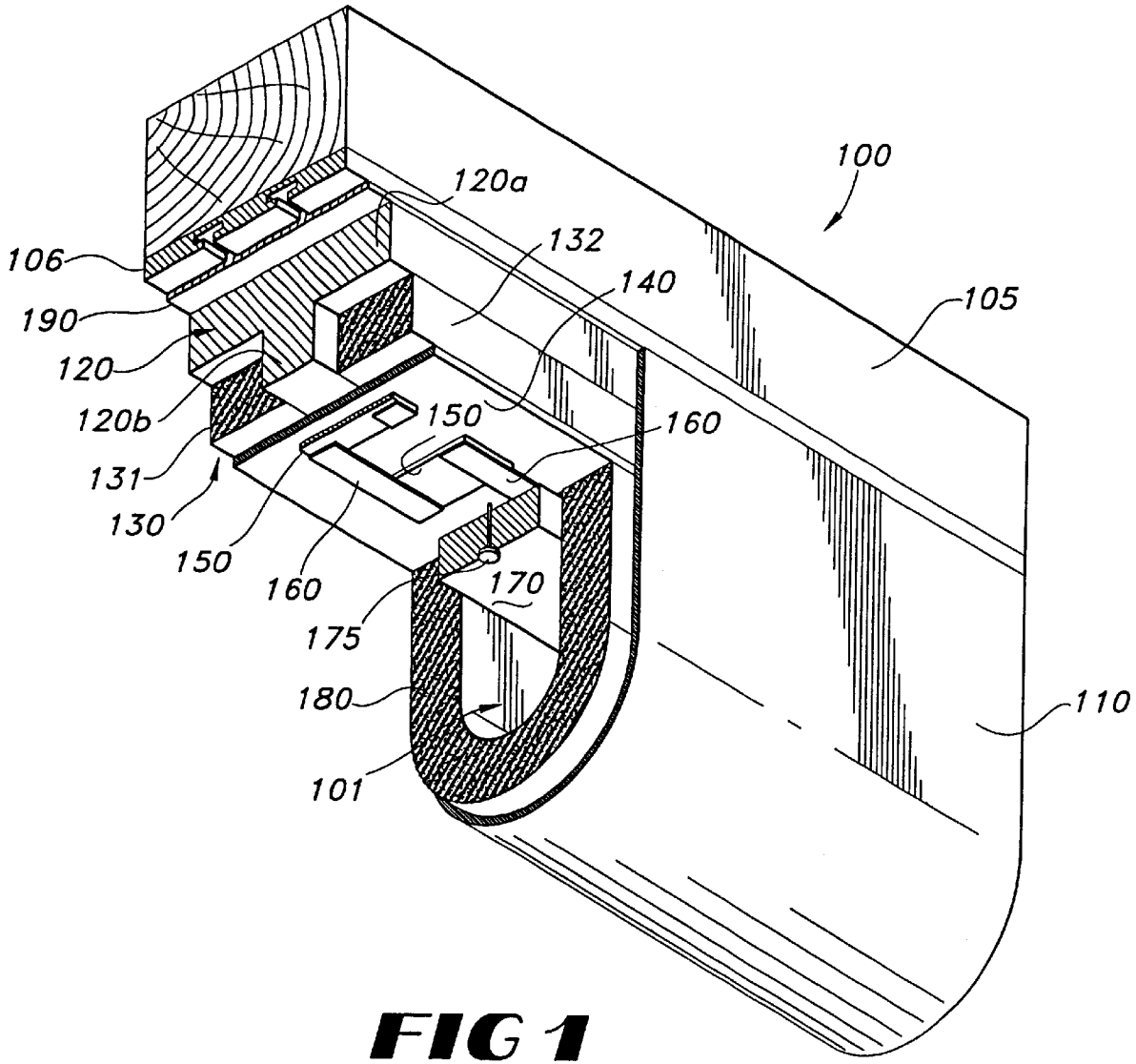
FIG. 1 is a cut-away perspective view of the apparatus of the safety edge switch of the present invention.

Referring now to FIG. 1, in a first embodiment the safety edge switch 100 includes a rigid base 120 which is an elongated member of preferably single piece construction having a generally T-shaped cross section formed by a cross arm portion 120*a* and a leg portion 120*b*. Base 120 can be fabricated from, for example, metal (e.g. stainless steel, iron, aluminum brass and various ferrous and non-ferrous alloys), wood, ceramic, and plastics (e.g. polycarbonates, nylon, polyolefin, polyvinyl chloride, acrylics, and the like).

A first resilient elastomerically deformable material 180 is preferably an elongated U-shaped member preferably fabricated from an elastomeric polymer foam (open or closed cell) of high density (relative to the low density foam described below) ranging from about 1 to about 30 pounds per cubic foot ("pcf"), more preferably from about 8 to about 12 pcf, and most preferably from about 10 to about 14 pcf. The first resiliently deformable material 180 should have strength sufficient for the purposes described below. Suitable polymeric foams can be fabricated from polyurethane, polyvinyl chloride ("PVC"), silicone, synthetic or natural rubber and other materials known in the art optionally the first resiliently deformable material 180 can be fabricated from a non-cellular material such as rubber.

The safety edge switch 100 includes an electrode array and an array of bridging members. The electrode array includes a plurality of segments 160 of a first conductive material, each segment being separated from neighboring segments by a gap. The array of electrodes 160 is held in a fixed position relative to base 120.

More particularly, the segments 160 of the electrode array are elongated and arranged longitudinally in two staggered rows. The electrodes 160 are fixedly attached to electrode support beam 170, which extends longitudinally and which is fixedly attached to the leg portion 120*b* of the T-shaped base 120 by, for example, fasteners 175, which can be nails, screws, or other suitable fasteners. Electrode support beam:170 can be fabricated from the same or different materials as base 120. The electrode segments 160 are preferably strips of metal such as copper, aluminum, stainless steel, silver or gold. Silver is preferred. The terminal segments at the end of the array are connected to an electric circuit by wires or conductive adhesives or coatings (not shown).

Figure 2:
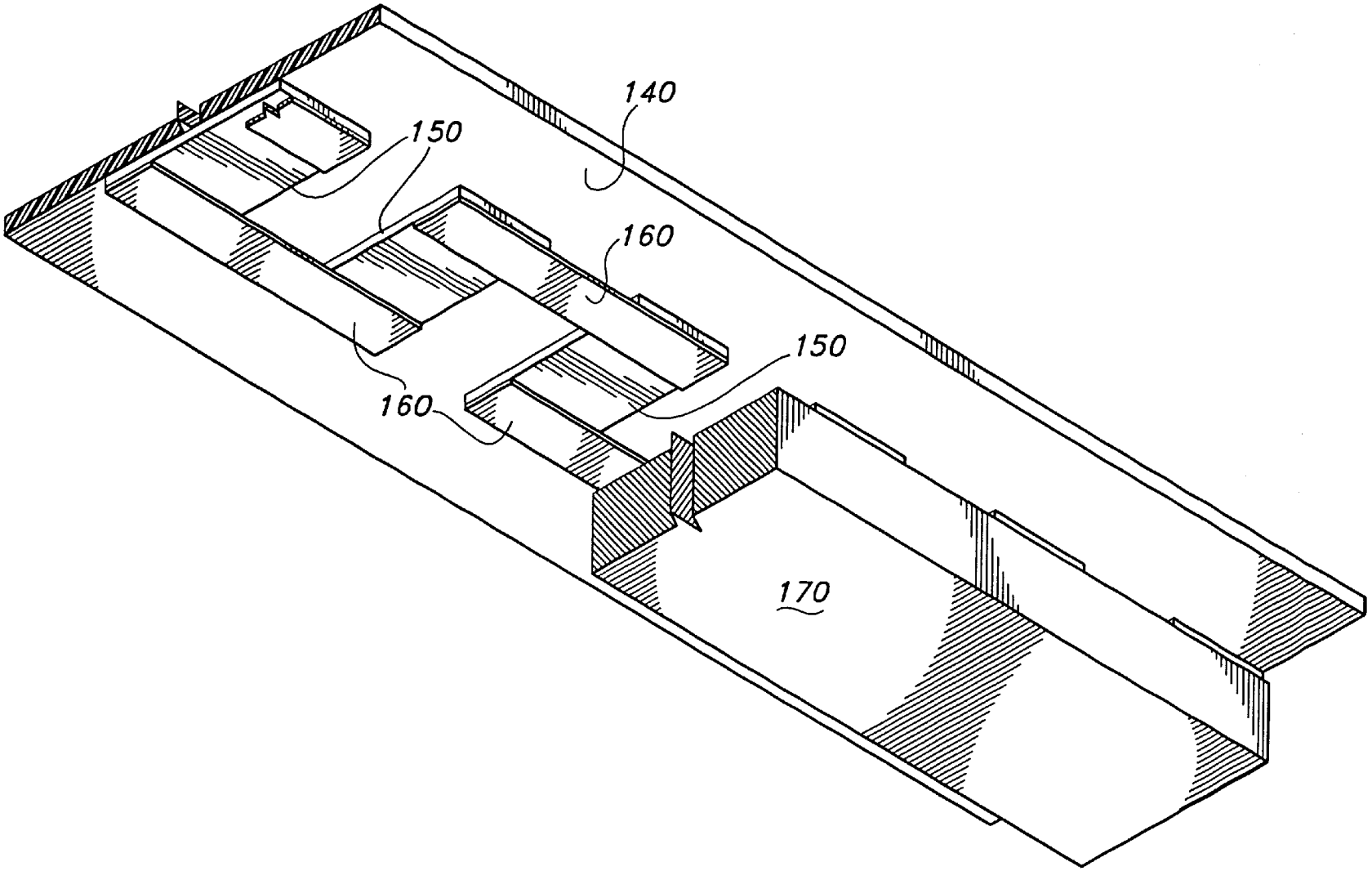
FIG. 2 is a cut-away perspective view of the electrodes and bridging members of the safety switch.

A movable switching mechanism includes an array of flexible conductive bridging members 150 which extend laterally and are positioned so as to contact a respective one of the electrode segments 160 bonded to the support beam 170 in one row and a respective one of the electrode segments 160 in the other row. As seen in FIG. 2, the combination of electrode segments 160 and bridging members 150 forms a crenelate configured electrical path. The array of bridging members 150 is fixed to a flexible sheet 140. Preferably, flexible sheet 140 is a polymeric sheet to which bridging members 150 are applied as a conductive flexible coating by, for example, silk screen printing, stencil spraying, transfer printing, and the like. Accordingly, the material for the bridging members 150 can be formulated as a conductive ink or coating fluid. A suitable formulation for the conductive coating material can be prepared by combining a binder (e.g. a polymeric resin), a solvent, and a conductive filler. This composition may be applied to the flexible sheet 140 as a fluid and then dried at ambient temperature or in an oven at elevated temperature. Suitable binders include polyurethane, plasticized PVC, silicone, natural and synthetic rubber and other suitable elastomeric compounds. The conductive filler can include finely powdered silver, copper, gold, aluminum particulates, and other such conductive metals. Various solvents can be used as thinners such as acetone, methyl ethyl ketone (MEK), tetrahydrofuran (THF), and the like.

The segments 160 of the electrode array can be of any size or configuration suitable for the purposes described herein. By way of example, suitable dimensions of each electrode segment includes a width ranging from about 1/16 inch to about 2 inches, preferably about 1/8 inch to about 1 inch, and a length of from about 1/8 inch to about 8 inches, preferably from about 1/4 inch to about 2 inches, although other dimensions may alternatively be employed. The bridging members 150 can have a width ranging from about 1/16 inch to about 2 inches and a length sufficient to bridge the space between the two rows of electrode segments 160 (e.g., about 1/16 inch to about 2 inches). Also by way of example the bridging members 150 and electrode segments 160 can have thicknesses ranging from about 0.01 mils to about 30 mils (1 mil=0.001 inch), preferably from about 1 mil to about 20 mils.

The safety sensing edge switch 100 preferable further includes a second resilient material 130 to bias the flexible sheet 140 to its original configuration. Second resiliently deformable material 130 is divided into two separate elongated sections, 131 and 132, each positioned on a respective side of leg portion 120*b* of the base 120 between the cross arm portion 120*a* and the flexible sheet 140. The second resiliently deformable material 130 is preferably a polymeric foam having a density and resistance to deformation less than that of the first resiliently deformable material 180. Second resiliently deformable material 130 may be fabricated from the same or different polymeric material as the first resiliently deformable material 180. Preferably second resiliently deformable material 130 is an elastomeric polymer foam having a density ranging from about 0.5 to about 15 pcf, more preferably from about 1 to about 5 pcf.

A flexible elastomeric cover 110 extends around the safety edge switch 100 to define a U-shaped enclosure. Cover 110 is fastened to the sides of base 120 by any suitable means such as adhesive bonding, solvent welding, etc. Cover 110 can be fabricated from, for example, plasticized PVC, rubber, polyurethane and the like.

A generally U-shaped void space 101 extends longitudinally along the interior of safety edge switch 100 to permit flexing of the switch upon contact with an object in the path of the door.

As shown in FIG. 1, the safety edge sensing switch 100 can optionally further include a mounting bracket 190 for mounting to a corresponding bracket 106 fixedly attached to the leading edge of a door 105.

Figure 4:
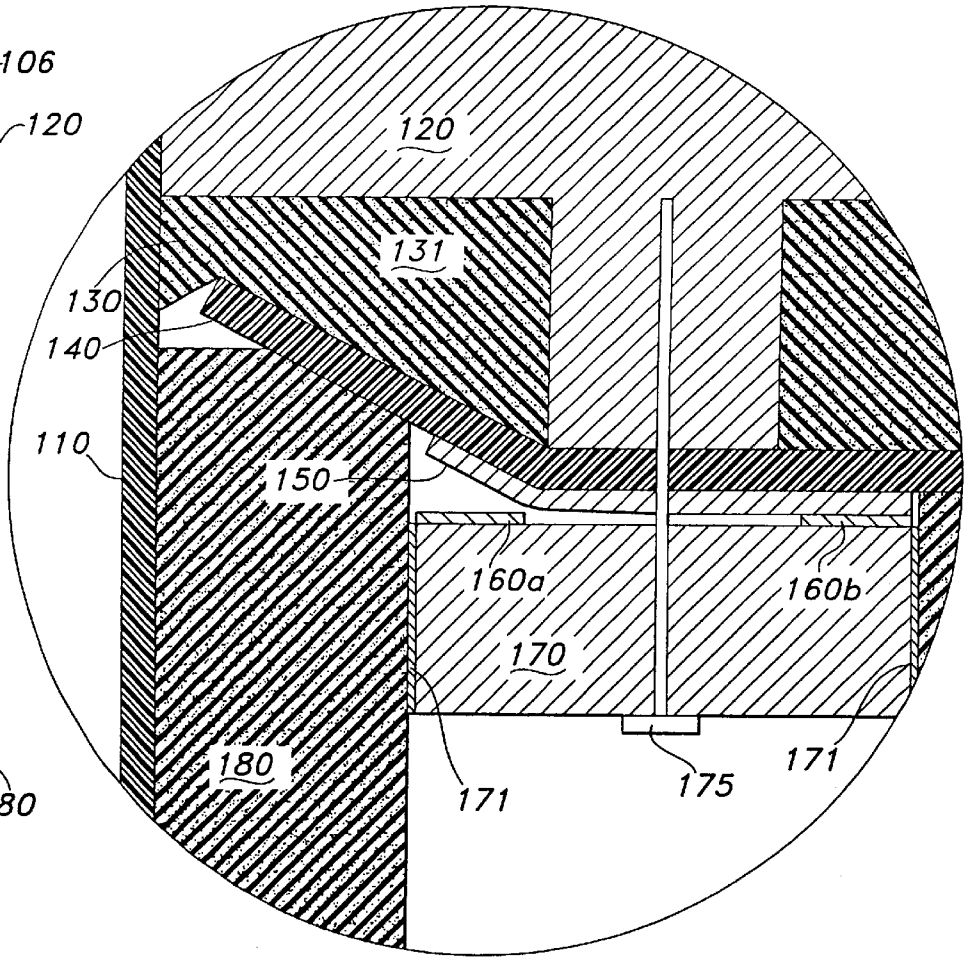
FIG. 4 is an enlarged sectional view of a portion of FIG. 3 illustrating the operation of the electrodes.
Figure 3:
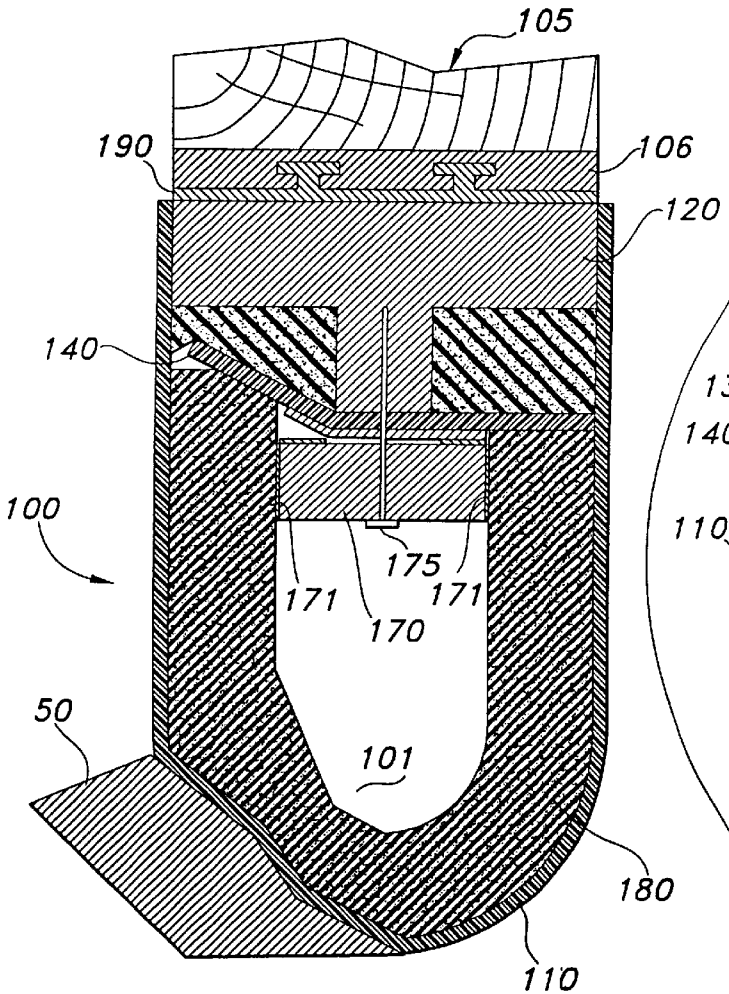
FIG. 3 is a sectional view illustrating the safety edge switch in operation.

Referring now to FIGS. 3 and 4, the operation of the safety edge switch 100 is illustrated. When the safety edge switch encounters an object 50 in the path of the moving door 105, at least a portion of the first resiliently deformable material 180 is pushed upward.

To facilitate the sliding movement of the first resiliently deformable material, it is preferred that the side surfaces of the electrode support beam 170 are provided with a film 171 of low friction material such as polytetrafluoroethylene (e.g., Teflon®) to reduce the sliding friction between the side surface of the electrode support beam 170 and the inner surface of the first resiliently deformable material 180.

As the upper end of the first resiliently deformable material 180 is raised, it pushes the flexible sheet 140 upward, which, in turn, moves the bridging member 150 out of contact with at least one segment 160*a* of the electrode array, thereby breaking the electric connection between segment 160*a* and segment. 160*b* and disrupting the electrical continuity of the electrical series relationship of the electrode segments 160. The bridging members 150, in conjunction with the electrode array segments 160, constitute an array of switching elements connected in electrical series. As can be seen, in FIG. 4, when the safety edge switch is activated it moves to an "open" switch configuration when at least one bridging member 150 breaks contact with a corresponding electrode segment 160.

The individual segments of electrode array 160 are planar. In this embodiment 100 the motion of at least one of the bridging members includes a vector component in a direction perpendicular to the plane of the respective electrode segment 160 from which it is lifted out of contact.

Figure 5:
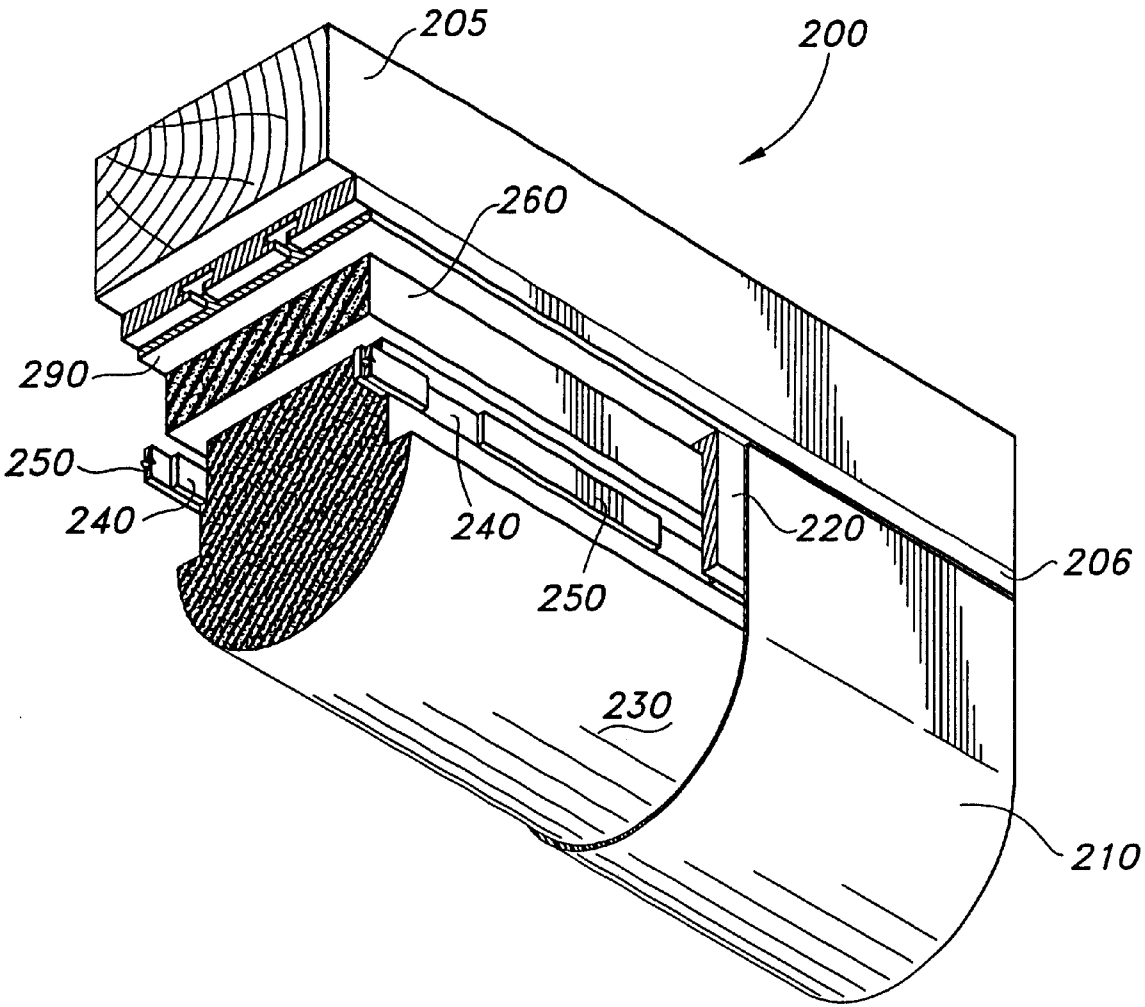
FIG. 5 is a cut-away perspective view of another embodiment of the safety edge switch.
Figure 7:
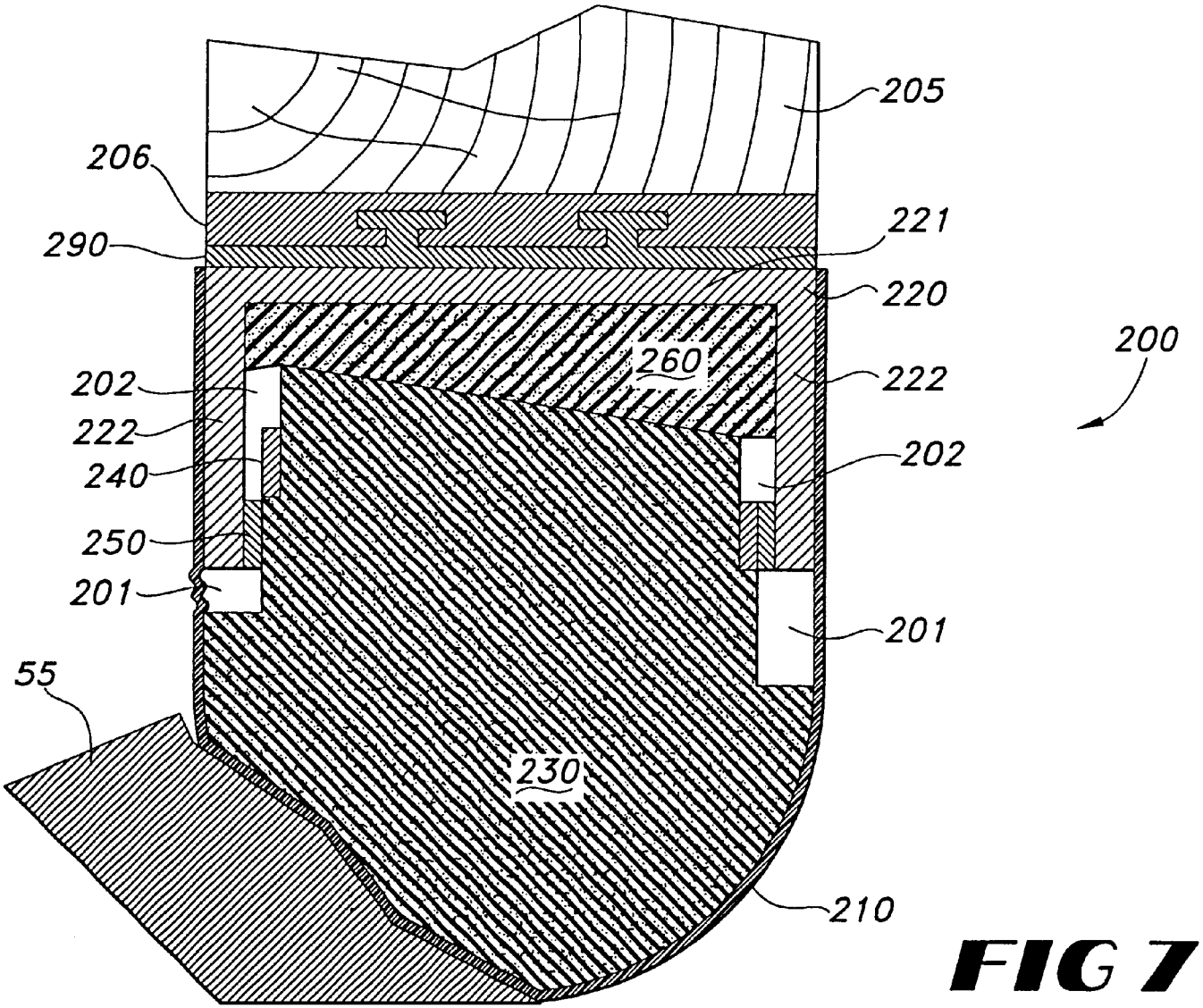
FIG. 7 is a sectional view illustrating the operation of the safety edge switch embodiment of FIG. 5.

Referring now to FIG. 5, an alternative embodiment 200 of the safety edge switch is illustrated which includes an elongated U-shaped rigid base 220 having a horizontal (as shown in FIG. 7) portion 221 and vertical (as shown in FIG. 7) leg portions 222. Base 220 can be fabricated from any suitable material such as described above with respect to base 120. A first resiliently deformable material 230 is preferably an elongated member fabricated from an elastomeric polymer foam (open or closed cell) of relatively high density (as compared to the relatively low density polymer foam of the second resiliently deformable material 260 described below). The density of first resiliently deformable material 230 and the material of fabrication may be the same as described above with respect to material 180 of the previously described embodiment.

The array of electrode segments 250 includes first and second rows of flat elongated electrode segments 251 and 252, which are spaced apart by gaps 253 and 254 respectively. Each row of electrode segments is fixedly attached to the inside surface of a respective leg portion 222 of the base.

Figure 6:
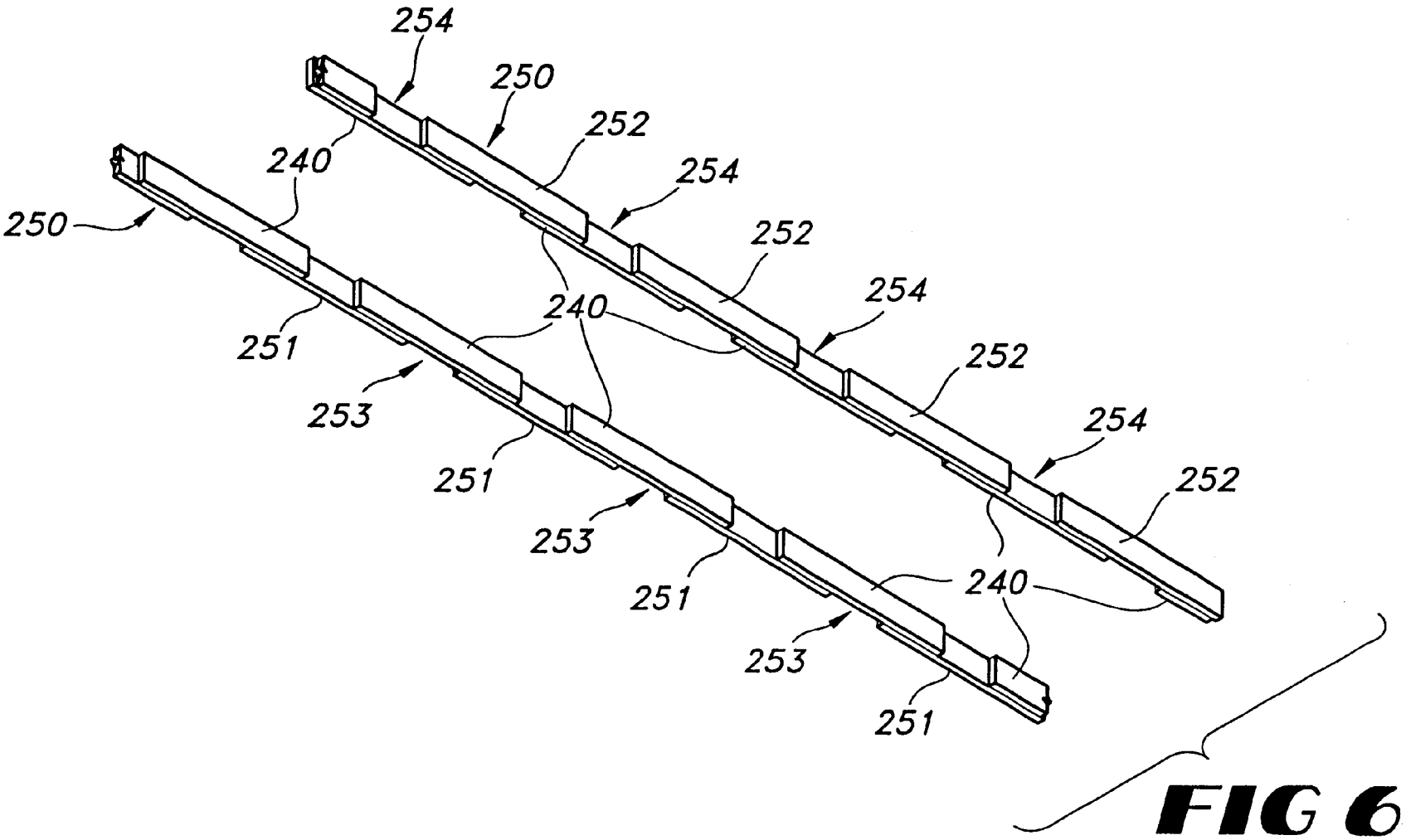
FIG. 6 is a perspective view of the electrode and bridging member structure of the embodiment of FIG. 5.

The bridging members 240 are likewise arrayed in first and second rows and are positioned so as to bridge the gaps 253 and 254, as shown in FIG. 6. Thus, each bridging member 240 is in slidable contact with facing end portions of neighboring electrode segments when the safety edge switch 200 is in the unactivated or initial configuration. Bridging members 240 are fixedly attached to the side of the first resiliently deformable material 230. When the first resiliently deformable material 230 is compressed by, for example, contact with an object in the path of the moving door, at least one of the bridging members 240 slides out of contact with at least one of the electrode segments 250 so as to create an open circuit. Both bridging members 240 and electrode segments 250 are preferably fabricated from metal strips, but can alternatively be conducting coatings applied to deformable material 230 and/or base 220, respectively. Electrode segments at one end of each of the rows are connected by wires to control circuitry for controlling movement of the door. The electrode segments at the opposite end of each row are connected to each other so that the entire array constitutes electrode segments in electrical series. A break in contact between any bridging member and any electrode segment will break the electrical path through the safety edge switch and cause an open circuit condition.

As shown in FIG. 7, the first resiliently deformable material 230 is shaped so as to define compression voids 201 and reception voids 202. The compression voids 201 facilitate the compression and sliding movement of the first resiliently deformable material 230. The reception voids 202 provide spaces into which the respective bridging members 240 can slide.

FIG. 7 illustrates the operation of the safety edge switch 200. Safety edge switch 200 is mounted to a door 205 by means of a mounting bracket 290 which engages a corresponding bracket 206 affixed to leading edge of door 205. When the safety edge switch 200 encounters an object 55 in the path of the moving door; at least a portion of the resiliently deformable material 230 is pushed upward. This movement causes one or more bridging members 240 to slide out of contact with the respective electrode segments 250, thereby causing an "open circuit" condition which halts current flow through the electrode array and signaling the motor control system to halt or reverse movement the door 205.

The motion of the bridging members 240 includes a vector component in a direction parallel to the plane of the respective electrode segment 250, i.e. the bridging member 240 slides across the surface of the electrode until it is out of contact therewith, rather than being lifted off perpendicularly as in the previously described embodiment 100.

An aspect of the present invention is illustrated by the following Example.

EXAMPLE 1

A conductive coating composition for use in preparing flexible bridging members was prepared by mixing the following components:

| Material | Amount |
|---|---|
| Polyurethane resin (Approximately 28.9 weight percent solids in tetrahydrofuran) | 3.5 g |
| Silver pigment | 9.0 g |
| Methyl ethyl ketone | 35 cc |

The conductive coating composition was applied by spray gun onto a flexible polymer sheet. The coating was allowed to dry. The resulting flexible coating had a resistance of 5 ohms per square.

While the above description contains many specifics, these specifics should not be construed as limitations on the invention, but merely as exemplifications of preferred embodiments thereof. Those skilled in the art will envision other possible variations that are within the scope and spirit of the invention as defined by the claims appended hereto.

What is claimed is:

1. A safety edge switch for a movable door which comprises:

a) a longitudinally extending elongated base;

b) a first resiliently deformable material;

c) an electrode array which includes a plurality of segments of a first conductive material, each segment being separated from neighboring segments by respective gaps, the electrode array being in a fixed position relative to the base; and, d) a second array which includes a plurality of spaced apart electrically conductive bridging members, the second array being movable in response to deformation of the first resiliently deformable material from a closed circuit first position wherein the bridging members are each in contact with respective segments of the first conductive material so as to bridge a respective gap between said respective segments, and a second position wherein at least one of the bridging members is not in contact with at least one respective segment of the electrode array, wherein in the closed circuit first position the segments of the electrode array are electrically connected in series so as to form an unbroken electrical path, and in the second position the electrical path is broken by at least one unbridged gap so as to form an open circuit.

2. The apparatus of claim 1 wherein the first resiliently deformable material is a first polymeric foam.

3. The apparatus of claim 2 wherein the first polymeric foam has a density of from about 1 to about 30 pcf.

4. The apparatus of claim 1 further including means for resiliently biasing the second array from said second position to said closed circuit first position.

5. The apparatus of claim 4 wherein the means for resiliently biasing the second array comprises a second resiliently deformable material.

6. The apparatus of claim 4 wherein the second resiliently deformable material is a second polymeric foam having a density of from about 0.5 to about 15 pcf.

7. The apparatus of claim 1 further comprising a flexible cover attached to the base and forming an enclosed space.

8. The apparatus of claim 1 further comprising mounting means attached to the base for mounting the safety edge switch to a movable door.

9. The apparatus of claim 1 wherein the first conductive material comprises metal strips or conductive coatings.

10. The apparatus of claim 5 further comprising a flexible sheet of polymeric material disposed between the second resiliently deformable material and the first resiliently deformable material, the second array of bridging members being supported on the flexible sheet of polymeric material.

11. The apparatus of claim 10 wherein the bridging members comprise a conductive coating applied to a side of the flexible sheet.

12. The apparatus of claim 10 wherein the segments of the first conductive material are elongated and arranged longitudinally in two staggered rows, wherein the bridging members each extend laterally from a respective one of the segments in one row to a respective one of the segments in the other row so as to form a crenelate configured electrical path.

13. The apparatus of claim 10 wherein the electrode array segments of conductive material lie in a plane, and wherein movement of the second array from the first position to the second position comprises motion of at least one bridging member having a vector component in a direction perpendicular to the plane of the segments of conductive material.

14. The apparatus of claim 1 wherein the electrode array is mounted to a solid electrode support which is fixedly attached to the base.

15. The apparatus of claim 5 wherein the electrode array is mounted to the base.

16. The apparatus of claim 15 wherein the bridging members are bonded to the first resiliently deformable material.

17. The apparatus of claim 16 wherein the electrode array segments of conductive material lie in a plane, and wherein movement of the second array from the first position to the second position comprises motion of at least one bridging member having a vector component in a direction parallel to the plane of the segments of conductive material.

18. The apparatus of claim 17 wherein the second resiliently deformable material is in contact with the base and the first resiliently deformable material.

19. A safety edge switch for a movable door which comprises:

a) a longitudinally extending elongated base;

b) a first resiliently deformable polymeric foam material;

c) a second resiliently deformable polymeric foam material d) an electrode array which includes a plurality of segments of a first conductive material, each segment being separated from neighboring segments by respective gaps, the electrode array being in a fixed position relative to the base;

e) a second array which includes a plurality of spaced apart electrically conductive bridging members, the second array being movable in response to deformation of the first resiliently deformable material from a closed circuit first position wherein the bridging members are each in contact with respective segments of the first conductive material so as to bridge a respective gap between said respective segments, and a second position wherein at least one of the bridging members is not in contact with at least one respective segment of the electrode array, wherein in the closed circuit first position the segments of the electrode array are electrically connected in series so as to form an unbroken electrical path, and in the second position the electrical path is broken by at least one unbridged gap so as to form an open circuit, said second array being resiliently biased to the first position by the second resiliently deformable polymeric foam material; and, f) a flexible cover attached to the base.

20. In combination:

a) a movable door;

b) an electric motor operatively connected to the door;

c) an electric control system for controlling movement of the door; and d) a safety edge switch attached to an edge of the door and operatively associated with the electric control system which includes:

i) a longitudinally extending elongated base;

ii) a first resiliently deformable material;

iii) an electrode array which includes a plurality of segments of a first conductive material, each segment being separated from neighboring segments by respective gaps, the electrode array being in a fixed position relative to the base; and, iv) a second array which includes a plurality of spaced apart electrically conductive bridging members, the second array being movable in response to deformation of the first resiliently deformable material from a closed circuit first position wherein the bridging members are each in contact with respective segments of the first conductive material so as to bridge a respective gap between said respective segments, and a second position wherein at least one of the bridging members is not in contact with at least one respective segment of the electrode array, wherein in the closed circuit first position the segments of the electrode array are electrically connected in series so as to form an unbroken electrical path, and in the second position the electrical path is broken by at least one unbridged gap so as to form an open circuit.

* * * * *